US008494427B2

(12) United States Patent
Nagao et al.

(10) Patent No.: US 8,494,427 B2
(45) Date of Patent: Jul. 23, 2013

(54) FIXING DEVICE, IMAGE FORMING APPARATUS, AND FIXING METHOD

(75) Inventors: Kazuya Nagao, Kanagawa (JP); Takuma Nakamura, Kanagawa (JP); Yuichi Aoyama, Kanagawa (JP); Masafumi Yamada, Kanagawa (JP); Shunichi Abe, Kanagawa (JP); Tetsurou Sasamoto, Kanagawa (JP); Takanori Inadome, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 299 days.

(21) Appl. No.: 13/085,934

(22) Filed: Apr. 13, 2011

(65) Prior Publication Data

US 2011/0275015 A1 Nov. 10, 2011

(30) Foreign Application Priority Data

May 7, 2010 (JP) ..... 2010-107015

(51) Int. Cl.
*G03G 15/20* (2006.01)

(52) U.S. Cl.
USPC ..... 399/340; 399/45; 399/67

(58) Field of Classification Search
USPC ..... 399/340, 44, 67
See application file for complete search history.

(56) References Cited

U.S. PATENT DOCUMENTS

| | | | | |
|---|---|---|---|---|
| 5,666,628 | A | 9/1997 | Fukai | |
| 7,713,673 | B2 | 5/2010 | Katano et al. | |
| 7,773,932 | B2 * | 8/2010 | Katano et al. | 399/340 |
| 7,813,689 | B2 | 10/2010 | Nakamura et al. | |
| 7,869,754 | B2 * | 1/2011 | Katano et al. | 399/340 |
| 8,019,267 | B2 * | 9/2011 | Katano et al. | 399/340 |
| 8,165,514 | B2 * | 4/2012 | Katano et al. | 399/340 |
| 2006/0263712 | A1 | 11/2006 | Katano et al. | |
| 2007/0243483 | A1 | 10/2007 | Katano et al. | |
| 2007/0253757 | A1 | 11/2007 | Tanaka et al. | |
| 2008/0063446 | A1 | 3/2008 | Katano et al. | |
| 2008/0213002 | A1 | 9/2008 | Katano et al. | |
| 2009/0003903 | A1 | 1/2009 | Katano et al. | |
| 2009/0067868 | A1 | 3/2009 | Arizumi et al. | |
| 2009/0067904 | A1 | 3/2009 | Katano et al. | |
| 2009/0151625 | A1 * | 6/2009 | Matsumoto et al. | 118/100 |
| 2011/0057988 | A1 * | 3/2011 | Izumikawa et al. | 347/21 |
| 2012/0135342 | A1 * | 5/2012 | Katano et al. | 430/104 |

FOREIGN PATENT DOCUMENTS

| | | |
|---|---|---|
| JP | 3290513 | 3/2002 |
| JP | 2007-304308 | 11/2007 |
| JP | 4149485 | 7/2008 |
| JP | 2009-8967 | 1/2009 |
| JP | 2009-69256 | 4/2009 |
| JP | 4302700 | 5/2009 |
| JP | 4387327 | 10/2009 |

* cited by examiner

*Primary Examiner* — David Gray
*Assistant Examiner* — Carla Therrien
(74) *Attorney, Agent, or Firm* — Oblon, Spivak, McClelland, Maier & Neustadt, L.L.P.

(57) ABSTRACT

A disclosed fixing device applying a bubble-like fixing liquid to resin-containing particles adhered to a medium so that the resin-containing particles are fixed to the medium, the bubble-like fixing liquid being formed by transforming a fixing liquid into foam that dissolves or swells at least a part of the resin, includes a control device that, based on a difference between a moisture content included in the medium after fixing and a target value of the moisture content, adjusts an application amount of the fixing liquid for a next medium.

12 Claims, 8 Drawing Sheets

FIG.3

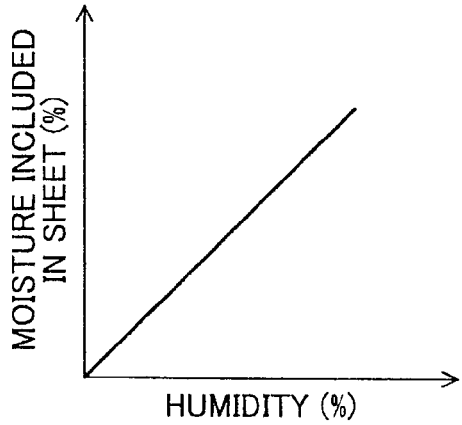

FIG.4

| | | |
|---|---|---|
| SOFTENER | DIETHOXYETHYL SUCCINATE (CRODA DES BY CRODA INC.) | 10wt% |
| | PROPYLENE CARBONATE | 20wt% |
| THICKENER | PROPYLENE GLYCOL | 10wt% |
| FOAMING AGENT | PALMITIC ACID AMINE | 2.5wt% |
| | MYRISTIC ACID AMINE | 1.5wt% |
| | STEARIC ACID AMINE | 0.5wt% |
| FOAM INCREASING AGENT | COCONUT FATTY ACID DIETHANOL AMIDE (1:1) TYPE (MAPON MM BY MATSUMOTO YUSHI SEIYAKU CO., LTD) | 0.5wt% |
| DISPERSING AGENT | POE(20)LAURYL SORBITAN (LEODOR TW-S120V BY KAO CORPORATION) | 1wt% |
| | POLYETHYLENEGLYCOL MONOSTEARATE (EMANON 3199 BY KAO CORPORATION) | 1wt% |
| DILUTION SOLVENT | ION-EXCHANGED WATER | 53wt% |

FIXING DEVICE, IMAGE FORMING APPARATUS, AND FIXING METHOD

CROSS-REFERENCE TO RELATED APPLICATIONS

The present application claims priority under 35 U.S.C §119 to Japanese Patent Application No. 2010-107015 filed May 7, 2010, the entire contents of which are hereby incorporated herein by reference.

BACKGROUND OF THE INVENTION

1. Field of the Invention

The present invention generally relates to a fixing device, an image forming apparatus, and a fixing method. More particularly, the present invention relates to a fixing device using a fixing liquid for dissolving or swelling toner, an image forming apparatus including the fixing device, and a fixing method using the fixing liquid for dissolving or swelling toner.

2. Description of the Related Art

An image forming apparatus such as a printer, a facsimile machine, a copier and the like forms images including characters and symbols on a recording medium such as paper, fiber, and a plastic sheet based on image information. Especially, an image forming apparatus using the electrophotographic method has been widely used because high-resolution images can be rapidly formed. In the image forming apparatus using the electrophotographic method, a fixing device using a heat fixing method is widely used where toner on the recording medium is heated to be melted, so that the melted toner is pressed to be fixed onto the recording medium. In this case, more than half of the power consumption is used for heating the toner.

On the other hand, recently, in the viewpoint of the countermeasures to the environmental problems, there has been a strong demand for reducing the power consumption (energy saving) of the image forming apparatuses. To that end, a fixing method used in the fixing device is provided for drastically reducing the temperature for heating toner or another fixing method used in the fixing device is provided where it is not necessary to heat toner (unheated fixing method). Especially, the unheated fixing method where toner is fixed onto the recording medium without heating any toner is more advantageous from the viewpoint of low power consumption.

For example, Japanese Patent No. 3290513 (Patent Document 1) discloses a wet-type toner fixing method where an oil droplet-in-water type fixing agent, in which an organic compound being capable of dissolving or swelling toner and being insoluble or difficult to be dissolved in water is dispersed and mixed in water, is sprayed or dropped onto a surface of a substrate to be subjected to fixing on which unfixed toner is arranged at a predetermined position so that the toner is dissolved or swelled, and subsequently the substrate to be subjected to fixing is dried out.

Further, Japanese Patent No. 4302700 (Patent Document 2) discloses a fixing device that applies a fixing agent onto resin particles formed on a recording medium based on the image information to be imaged, the fixing agent including softener softening resin particles including resin by dissolving or swelling at least a part of the resin. The fixing device includes a foam-like solution generating unit forming the foam-like fixing agent, a film thickness control unit controlling the film thickness of the foam-like fixing agent generated by the foam-like solution generating unit, and an application unit applying the foam-like fixing agent having the controlled thickness to the resin particles on the recording medium.

Japanese Patent Application Publication No. 2009-69256 (Patent Document 3) discloses a temperature holding device and an image forming apparatus including the temperature holding device, the temperature holding device including a container entirely or partially made of a thermal storage member for containing a fixing liquid dissolving or swelling toner, a heating unit disposed in a main body of the image forming apparatus and heating the thermal storage member of the temperature holding device, a liquid temperature detection unit detecting the temperature of the fixing liquid in the container, a control unit controlling the heat quantity transferred from the heating unit to the thermal storage member based on the detection result by the liquid temperature detection unit, and a fixing liquid fixing unit applying the fixing liquid stored in the container so that the toner on the recording medium is fixed onto the recording medium.

However, when the wet-type toner fixing method disclosed in Patent Document 1 is used, the oil droplet-in-water type fixing agent in which an organic compound being capable of dissolving or swelling toner and being insoluble or difficult to be dissolved in water is dispersed and mixed in water is used. Because of this feature, when a large amount of fixing agent is applied to unfixed toner, a recording medium (an object on which the fixing agent is to be fixed) such as a transfer sheet may absorb water included in the fixing agent so as to crinkle or curl. As a result, a stable and quick feeding recording medium which is necessary in the image forming apparatus may be degraded.

To resolve the problem, a drying device may be provided so as to evaporate the large amount of water included in the fixing agent and having been applied to the recording medium. In this method, however, power comparable to the power consumption of an image forming apparatus using the heat fixing method may be necessary.

Further, in a case where a fixing liquid is applied to a unfixed toner layer on the recording medium by using an application roller, when the fixing liquid layer on the application roller is thinner than the unfixed toner layer, at the position where the application roller is separated from the recording medium, unfixed toner particles are pulled by the surface tension generated by the liquid film of the fixing liquid on the surface of the application roller. As a result, a so-called toner offset where toner particles are adhered to the surface of the application roller may be generated, thereby remarkably deteriorating the image on the recording medium.

On the other hand, when the fixing liquid layer on the application roller is sufficiently thicker than the unfixed toner layer, at the position where the application roller is separated from the recording medium, the surface tension generated by the liquid film of the fixing liquid on the surface of the application roller may make it hard for the fixing liquid to be directly applied to the toner particles due to there being too much liquid. As a result, it may be difficult for the toner to be transferred to the roller side but a large amount of fixing liquid is applied to the sheet surface. Because of the features, the toner particles may be swept onto the recording medium due to excessive fixing liquid, or drying time is increased, so that fixing reliability may be degraded. Further, in this case, the recording medium may remain in a wet state (i.e., when the recording medium is touched, the wet feeling is recognized). Further, in a case where the fixing liquid includes water, when a large amount is applied to the recording medium including cellulose such as paper, the recording medium may remarkably curl, thereby causing a paper jam when the recording medium is fed in an apparatus such as an image forming apparatus.

On the other hand, in order to improve the fixing reliability, reduce the wet feeling, and prevent the curling, it may be necessary that only a slight amount of fixing liquid is applied to the toner layer on the recording medium. However, when the wet-type toner fixing method disclosed in Patent Document 1 is used, it may be very difficult to achieve a good balance between the slight amount of application of the fixing liquid to the toner layer on the recording medium and the prevention of the toner offset to the application roller. Further, even in a case where a daicoat unit, a blade application unit, or a wire-bar application unit is used as a contact application unit, when the amount of fixing liquid is small, toner may be adhered to the contact application unit due to the surface tension, which may degrade the image quality.

On the other hand, in the viewpoints of eliminating the printing failures including the toner offset and reducing the consumption amount of the fixing liquid, it may be necessary to stably supply the fixing liquid to the recording medium regardless of the usage environment.

However, when the fixing device disclosed in Patent Document 2 or the image forming apparatus disclosed in Patent Document 3 is used, it may be possible to achieve a good balance between the slight amount of application of the fixing liquid to the toner layer on the recording medium and the prevention of the toner offset to the application roller. However, in those inventions, no environmental fluctuation is considered. Therefore, for example, when moisture (moisture content, water amount) in the recording medium changes due to atmospheric humidity change, the penetration rate of the fixing liquid into the recording medium changes accordingly. As a result, due to the change of the penetration rate of the fixing liquid, the fixing characteristic may vary.

Namely, when the atmospheric humidity is low, a larger amount of fixing liquid is absorbed into the recording medium even when the same amount of the fixing liquid is supplied as the amount of the fixing liquid when the atmospheric humidity is high. As a result, increased moisture (increased moisture content) in the recording medium may exceed the desired amount. On the other hand, when the atmospheric humidity is high, the increased moisture in the recording medium may be less than the desired amount.

Further, when the increased moisture in the recording medium is large, a curl or crinkle may be generated. Further, when the increased moisture in the recording medium fluctuates, printing failure may occur depending on the fluctuation amount. Further, in continuous printing, if no control is performed on the increased moisture in the recording medium to be maintained constant, the fixing liquid more than necessary may be consumed, thereby increasing the frequency of replacing the consumable supply of the fixing liquid.

SUMMARY OF THE INVENTION

The present invention is made in light of the above circumstances, and may provide a fixing device stably applying an appropriate amount of a fixing liquid to a recording medium regardless of the usage environment.

According to an aspect of the present invention, there is provided a fixing device applying a bubble-like fixing liquid to resin-containing particles adhered to a medium so that the resin-containing particles are fixed to the medium, the bubble-like fixing liquid being formed by transforming a fixing liquid into foam that dissolves or swells at least a part of resin, the fixing device including a control device that, based on a difference between a moisture content included in the medium after fixing and a target value of the moisture content, adjusts an application amount of the fixing liquid for a next medium.

BRIEF DESCRIPTION OF THE DRAWINGS

Other objects, features, and advantages of the present invention will become more apparent from the following description when read in conjunction with the accompanying drawings, in which:

FIG. 3 is a graph illustrating an exemplary humidity-moisture calibration curve;

FIG. 4 is a table illustrating an exemplary composition of a fixing liquid;

DETAILED DESCRIPTION OF THE PREFERRED EMBODIMENTS

Figure 1:
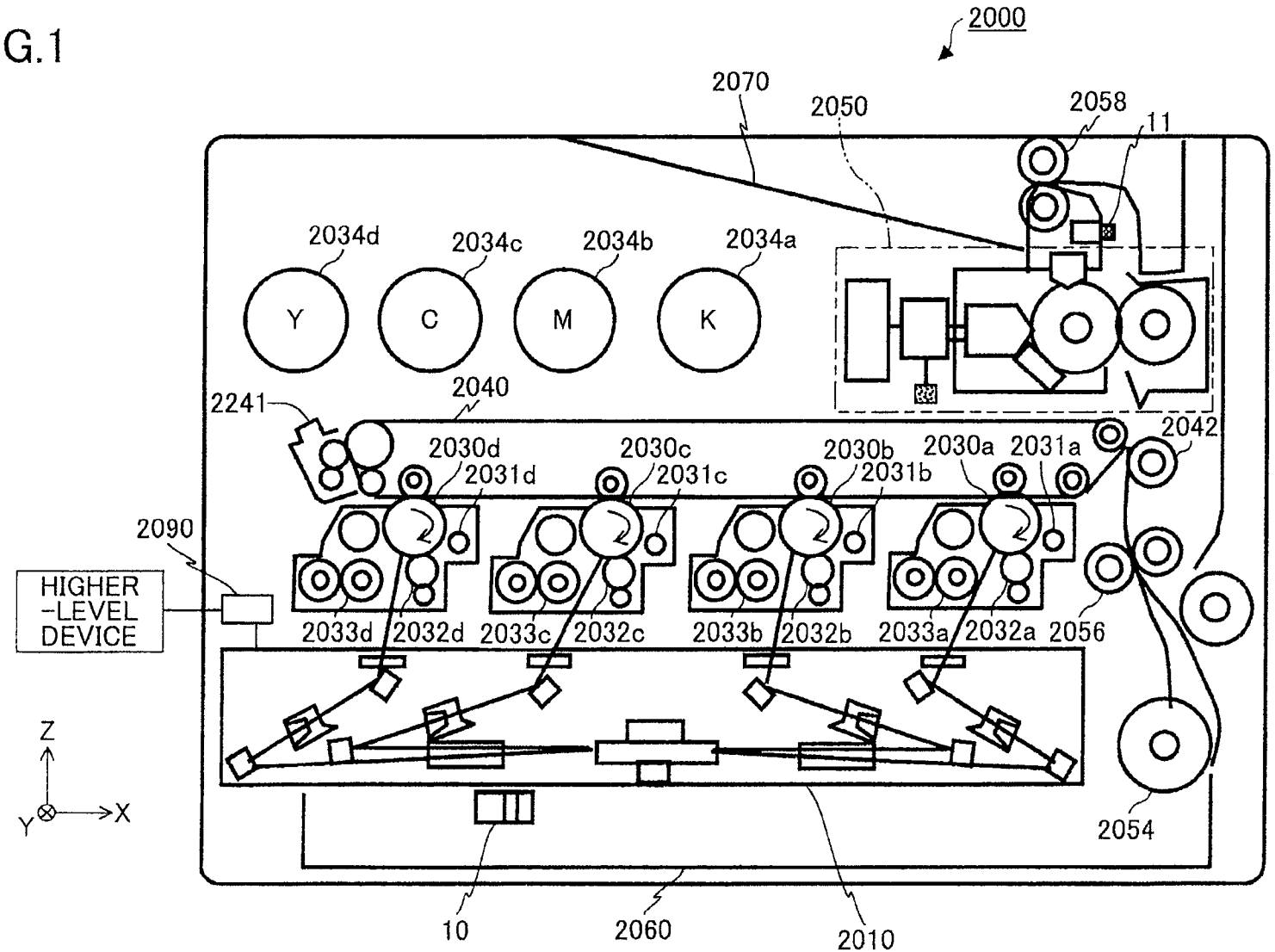
FIG. 1 is a schematic drawing of an exemplary configuration of a color printer according to an embodiment of the present invention.

In the following, an embodiment of the present invention is described with reference to FIGS. 1 through 10. FIG. 1 schematically illustrates a color printer 2000 as an image forming apparatus according to an embodiment of the present invention.

The color printer 2000 is a tandem type multi-color printer forming full-color images by overlapping four colors (black, cyan, magenta, and yellow). As illustrated in FIG. 1, the color printer 2000 includes an optical scanning device 2010, four photosensitive drums (2030*a*, 2030*b*, 2030*c*, and 2030*d*), four cleaning devices (2031*a*, 2031*b*, 2031*c*, and 2031*d*), four charging devices (2032*a*, 2032*b*, 2032*c*, and 2032*d*), four development devices (2033*a*, 2033*b*, 2033*c*, and 2033*d*), four toner bottles (2034*a*, 2034*b*, 2034*c*, and 2034*d*), a transfer belt 2040, a transfer roller 2042, a fixing device 2050, a sheet feeding roller 2054, a resist roller pair 2056, a sheet discharging roller 2058, a sheet feeding tray 2060, a sheet discharging tray 2070, a belt cleaning device 2241, a humidity sensor 10, a moisture detector 11, a recording sheet detection sensor 12 (not shown in FIG. 1 but shown in FIG. 2), a printer control device 2090 and the like.

Herein, for explanatory purposes, it is assumed that the color printer 2000 is disposed in the XYZ three-dimensional coordinate system as illustrated in the figures, in which the Y axis extends in the direction parallel to the longitudinal direction of the photosensitive drums (2030*a*, 2030*b*, 2030*c*, and 2030*d*), and the X direction extends in the direction parallel to the arranging direction of the four photosensitive drums (2030*a*, 2030*b*, 2030*c*, and 2030*d*).

The printer control device 2090 collectively controls the above components and further controls bi-directional communications with a higher-level device such as a personal computer via a network.

The photosensitive drums (2030*a*, 2030*b*, 2030*c*, and 2030*d*) include photosensitive layers formed on the surfaces of the respective photosensitive drums. Namely, the surfaces of the photosensitive drums are respective surfaces to be scanned. Further, it is assumed that the photosensitive drums rotate in the respective arrow directions in FIG. 1.

In the vicinity of the surface of the photosensitive drum 2030*a*, along the rotation direction of the photosensitive drum 2030*a*, the charging device 2032*a*, the development device 2033*a*, and the cleaning device 2031*a* are arranged in this order.

The photosensitive drum 2030*a*, the charging device 2032*a*, the development device 2033*a*, and the cleaning device 2031*a* are used as a group and constitute an image forming station forming black images (hereinafter may be referred to as "K station" for convenience sake).

In the vicinity of the surface of the photosensitive drum 2030*b*, along the rotation direction of the photosensitive drum 2030*b*, the charging device 2032*b*, the development device 2033*b*, and the cleaning device 2031*b* are arranged in this order.

The photosensitive drum 2030*b*, the charging device 2032*b*, the development device 2033*b*, and the cleaning device 2031*b* are used as a group and constitute an image forming station forming magenta images (hereinafter may be referred to as "M station" for convenience sake).

In the vicinity of the surface of the photosensitive drum 2030*c*, along the rotation direction of the photosensitive drum 2030*c*, the charging device 2032*c*, the development device 2033*c*, and the cleaning device 2031*c* are arranged in this order.

The photosensitive drum 2030*c*, the charging device 2032*c*, the development device 2033*c*, and the cleaning device 2031*c* are used as a group and constitute an image forming station forming cyan images (hereinafter may be referred to as "C station" for convenience sake).

In the vicinity of the surface of the photosensitive drum 2030*d*, along the rotation direction of the photosensitive drum 2030*d*, the charging device 2032*d*, the development device 2033*d*, and the cleaning device 2031*d* are arranged in this order.

The photosensitive drum 2030*d*, the charging device 2032*d*, the development device 2033*d*, and the cleaning device 2031*d* are used as a group and constitute an image forming station forming yellow images (hereinafter may be referred to as "Y station" for convenience sake).

The charging devices (2032*a*, 2032*b*, 2032*c*, and 2032*d*) uniformly and electrically charge the surfaces of the photosensitive drums (2030*a*, 2030*b*, 2030*c*, and 2030*d*), respectively.

The optical scanning device 2010 irradiates light fluxes of each color modulated based on the multi-color image information (i.e., black image information, cyan image information, magenta image information, and yellow image information) from the higher-level device, so that the light fluxes are irradiated onto the surfaces of the corresponding electrically charged photosensitive drums. By doing this, on the surfaces of the photosensitive drums, electrical charges on the irradiated parts are dissipated, so that the latent images corresponding to the image information are formed on the surfaces of the respective photosensitive drums. Herein, the formed latent images are fed toward the corresponding development devices along the rotation directions of the photosensitive drums.

Toner bottle 2034*a* stores black toner to be supplied to the development device 2033*a*. Toner bottle 2034*b* stores magenta toner to be supplied to the development device 2033*b*. Toner bottle 2034*c* stores cyan toner to be supplied to the development device 2033*c*. Toner bottle 2034*d* stores yellow toner to be supplied to the development device 2033*d*.

The toner of each color includes a coloring material, a charge control material, resin such as binder resin and a release agent. The resin included in the toner is not limited to specific resin. As preferable binder resin, polystyrene resin, styrene-acrylic copolymer resin, polyester resin or the like may be used. As a preferable release agent, for example, a wax component such as carbana wax, polyethylene or the like may be used.

The toner may further include known colorant, a charge control agent, a fluidity-improving agent, an external additive or the like.

Further, the toner is preferably subject to water-repellent treatment by firmly fixing hydrophobic particles such as hydrophobic silica or hydrophobic titanium oxide having a methyl group to the surface of the toner particles.

As the development devices rotate, the toner from the toner bottles is thinly and uniformly applied to the surfaces of the corresponding development devices. When the toner on the surfaces of the development devices is in contact with the surfaces of the respective photosensitive drums, the toner is transferred and adhered only to parts where light has been irradiated on the surfaces. In other words, the development devices make the latent images formed on the surfaces of the corresponding photosensitive drums visible by adhering the toner to the latent images. The images to which the toner are adhered (toner image) is fed toward the transfer belt 2040 as the photosensitive drums rotate.

The cleaning devices remove the toner remaining on the surfaces of the corresponding photosensitive drums (residual toner). After the residue toner is removed from the surfaces of the photosensitive drums, the surfaces are rotated (returned) to their positions where the surfaces face the corresponding charging devices again.

The toner images in yellow, magenta, cyan, and black colors are sequentially transferred to the transfer belt 2040 to be superposed.

In the sheet feeding tray 2060, recording sheets are stored. In the vicinity of the sheet feeding tray 2060, there is the sheet feeding roller 2054. The sheet feeding roller 2054 picks up the recording sheets from the sheet feeding tray 2060 one by one and sequentially feeds the picked-up recording sheets to the resist roller pair 2056. The resist roller pair 2056 sequentially feeds the recording sheets in between the transfer belt 2040 and the transfer roller 2042. By doing this, the toner image on the transfer belt 2040 is transferred to the recording sheet. Namely, the toner image corresponding to the image is formed on the recording sheet. The recording sheet on which the toner image is formed is fed to the fixing device 2050.

Further, instead of using the recording sheet, for example, a plastic film such as an OHP sheet having a liquid permeation layer may be used.

The humidity sensor 10 is disposed near the sheet feeding tray 2060, and converts the humidity information into an electric signal.

The fixing device 2050 softens the resin included in the toner on the recording sheet by using a fixing liquid, and presses the recording sheet so that the toner layer on the recording sheet is fixed to the recording sheet.

Figure 2:
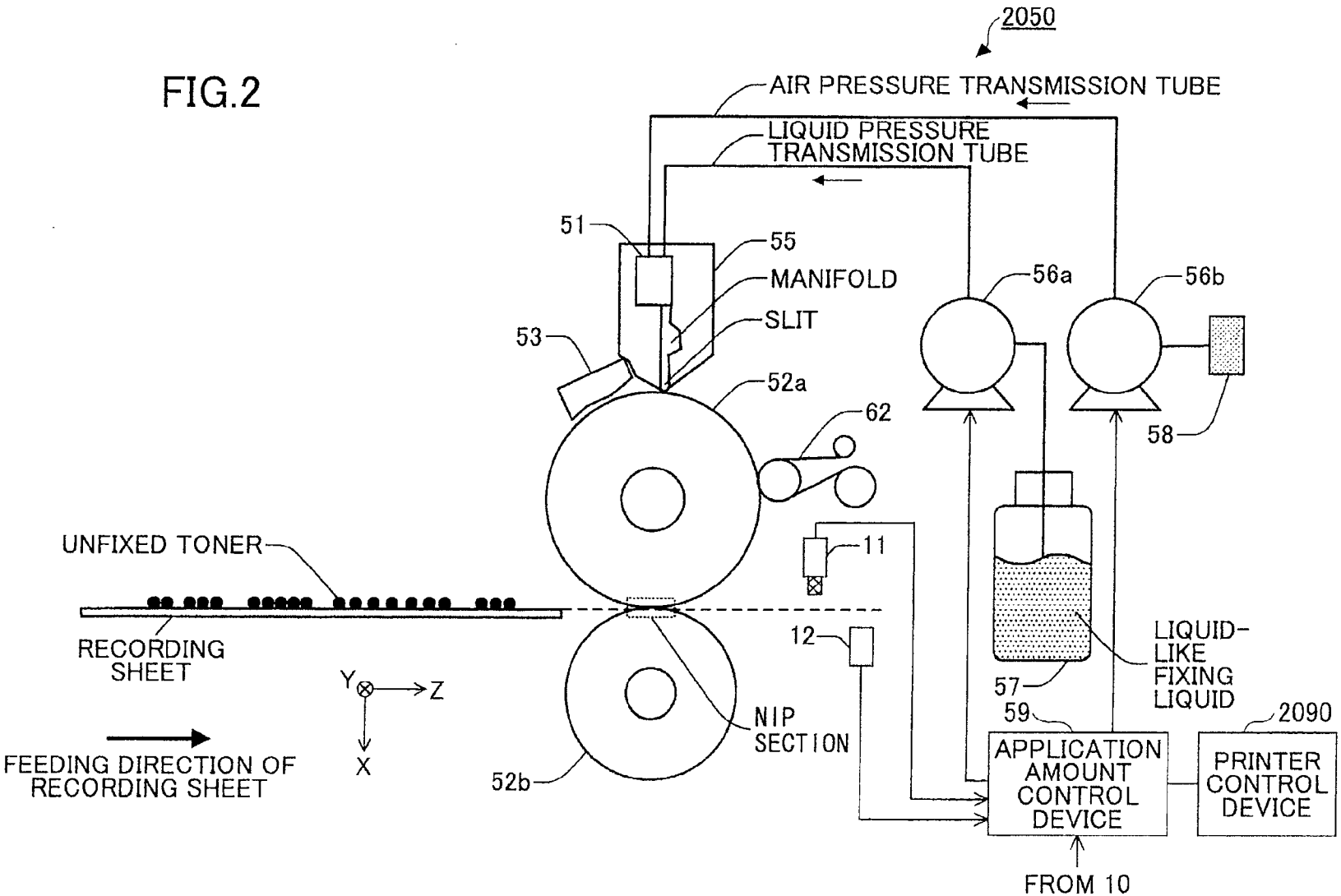
FIG. 2 is a drawing illustrating a fixing device in FIG. 1.

FIG. 2 illustrates an exemplary configuration of the fixing device 2050 according to an embodiment of the present invention. As illustrated in FIG. 2, the fixing device 2050 includes a bubble generation device 51, an application roller 52*a*, a pressing roller 52*b*, a blade 53, an application head 55, a liquid-like fixing liquid supply pump 56*a*, an air supply pump 56*b*, a liquid-like fixing liquid container 57, a filter 58, an application amount control device 59, a cleaning device 62 and the like. Herein, it is assumed that the toner image has been transferred on the −X side of the recording sheet, and that the recording sheet is fed toward the +Z direction. Further in the following, the −X side of the recording sheet may be called a "front surface" and the +X side of the recording sheet may be called a "rear surface".

The application amount control device 59 includes a CPU (Central Processing Unit), a ROM (Read Only Memory), a RAM (Random Access Memory) and the like. The ROM stores a program and data, the program being written in a code readable by the CPU, the data being to be used when the program is executed. The RAM is used as a working memory.

Further, for each of the types of the sheets, in advance, the relationships between humidity (%) and moisture included in the sheet are obtained (the relationships are expressed by using (may be referred to as) a "humidity-moisture calibration curve") and are stored in the ROM of the application amount control device 59.

The application roller 52*a* has its longitudinal direction parallel to the Y axis direction, and rotates in the counter-clockwise direction in FIG. 2 around an axis parallel to the Y axis. The pressing roller 52 has its longitudinal direction parallel to the Y axis direction, and rotates in the clockwise direction around an axis parallel to the Y axis.

The application roller 52*a* and the pressing roller 52*b* are arranged in the X axis direction so as to in contact with each other, so that the recording sheet is fed in between the application roller 52*a* and the pressing roller 52*b*. Herein, the pressing roller 52*b* is displaced on the +X side of the application roller 52*a*. Further, in the Z direction, the section from the contact start point where the application roller 52*a* starts to be in contact with the recording sheet and the separation start point where the application roller 52*a* starts separating from the recording sheet is called a "nip section".

In this embodiment, as the application roller 52*a*, a roller of 50 mm diameter (ϕ=50 mm) made of stainless steel on which PFA (Perfluoroalkoxy) rein which is releasable fluorine resin is baked and finished, is used. Further, as the pressing roller 52*b*, a roller having an internal roller (i.e., core metal) and an outer roller, the inner roller (core metal) having the diameter of 10 mm (ϕ=10 mm) and made of aluminum alloy, the outer roller having an outer diameter of 50 mm (ϕ=50 mm) and made of polyurethane foam material (product name: "Color foam EMO" by INOAC Corporation) is used.

The liquid-like fixing liquid supply pump 56*a* supplies liquid-like fixing liquid in the liquid-like fixing liquid container 57 to the bubble generation device 51 via a liquid pressure transmission tube. The supply amount (liquid supply amount) supplied by the liquid-like fixing liquid supply pump 56*a* is controlled by the application amount control device 59.

As the fixing liquid (liquid-like fixing liquid), a known material (as described in, for example, Japanese Patent Application Publication No. 2009-8967) may be used.

FIG. 4 illustrates a composition of the fixing liquid used in this embodiment. In the composition of FIG. 4, the dispersant is used to promote the solubility when the softener is diluted with solvent. Further, the fatty acid amine is synthesized from fatty acid and triethanolamine.

In this case, first, plural materials excluding the softener are mixed and agitated at the liquid temperature of 120° C. to prepare a solution. Next, the solution and the softener are mixed so that the softener dissolves in the solution using an ultrasonic homogenizer to prepare the fixing liquid.

Further, as the liquid-like fixing liquid supply pump 56*a*, a gear pump, a bellows pump or the like may be used. However, preferably, a tube pump is used. For example, if a pump such as the gear pump in which a vibration mechanism or a rotation mechanism is to be provided to pump the fixing liquid, bubbles may be generated in the fixing liquid in the pump, so that the fixing liquid has compressibility. As a result, the transportation capability may be reduced. Further, the parts of the pump may contaminate the fixing liquid, and on the other hand, the parts of the pump may be damaged by the fixing liquid.

On the other hand, according to the mechanism of the tube pump, the tube is deformed so that the liquid in the tube is squeezed. Therefore, the part to be in contact with the fixing liquid is the tube only. Therefore, by using a tube having resistance against the fixing liquid, it may become possible to easily prevent the contamination of the liquid and the damage of the parts of the pump. Further, due to the mechanism of the pump being that the pump simply deforms the tube, bubbles may not be generated and the reduction of the transportation capability may be prevented.

In this embodiment, as the liquid-like fixing liquid supply pump 56*a*, a flow-rate controllable micro fluid feed pump (model uf-3000 by Denso Kogyo Co., Ltd) is used. Further, as the liquid pressure transmission tube, a Teflon tube (model 2-435-04 by As One Corporation, "Teflon" is a trademark of Du Pont).

Referring back to FIG. 2, the air supply pump 56*b* supplies air having passed through the filter 58 to the bubble generation device 51 via an air pressure transmission tube. The supply amount (air supply amount) supplied by the air supply pump 56*b* is controlled by the application amount control device 59.

In this embodiment, as the air supply pump 56*b*, an electromagnetic air pump (model MV-10H by Enomoto Micro Pump Mfg. Co. Ltd.) is used. Further, the air supply pump 56*b* is equipped with a mass flow meter for (model MQV0002 by Yamatake Co., Ltd.) for controlling air flow rate. As the air pressure transmission tube, a polyurethane tube is used.

By having the configuration described above, it may become possible to quantitatively supply desired volumes of the liquid-like fixing liquid and air to the bubble generation device 51.

As illustrated in FIG. 2, the bubble generation device 51 is disposed on the −X side of the application roller 52*a* and generates bubble-like fixing liquid by getting air supplied via the air pressure transmission tube into the liquid-like fixing liquid supplied via the liquid pressure transmission tube. Further, in the following, a ratio between the air and the liquid-like fixing liquid supplied to the bubble generation device 51 is called (simplified as) an "air-liquid ratio" for convenience purposes. Further, in the following, a mixing ratio between the liquid (fixing liquid) and air in the generated bubble-like fixing liquid is called (simplified as) a "bubble density".

As illustrated in FIG. 2, the application head 55 is disposed on the −X side of the application roller 52*a*, and supports (holds) the bubble generation device 51. Further, the application head 55 forms (provides) a flow path of the bubble-like fixing liquid ejected from the bubble generation device 51. On the flow path, there is a manifold to reduce the transfer pressure of the bubble-like fixing liquid. Further, a slit is formed at the end of the flow path. From the slit, the bubble-like fixing liquid is supplied to the surface of the application roller 52*a*.

In this embodiment, while passing through the manifold where the fluid resistance is low, the bubble-like fixing liquid discharged from the bubble generation device 51 is spread in the width direction (in this embodiment, the Y axis direction) of the recording sheet. Then, while passing through the slit where the fluid resistance is high, the bubble-like fixing liquid is formed (adjusted) so as to have a uniform film thickness.

In this embodiment, the application head 55 includes a body made of stainless steel (SUS303). Further, the slit is formed so as to have a slit length (i.e., length in the Y axis direction) of 300 mm and a slit width (i.e., length in the Z axis direction) of 500 μm.

Further, in the following, a part including the bubble generation device 51, the liquid-like fixing liquid supply pump 56*a*, the air supply pump 56*b*, the liquid-like fixing liquid container 57, and the filter 58 may be called a "bubble-like fixing liquid supplying apparatus".

Figure 5:
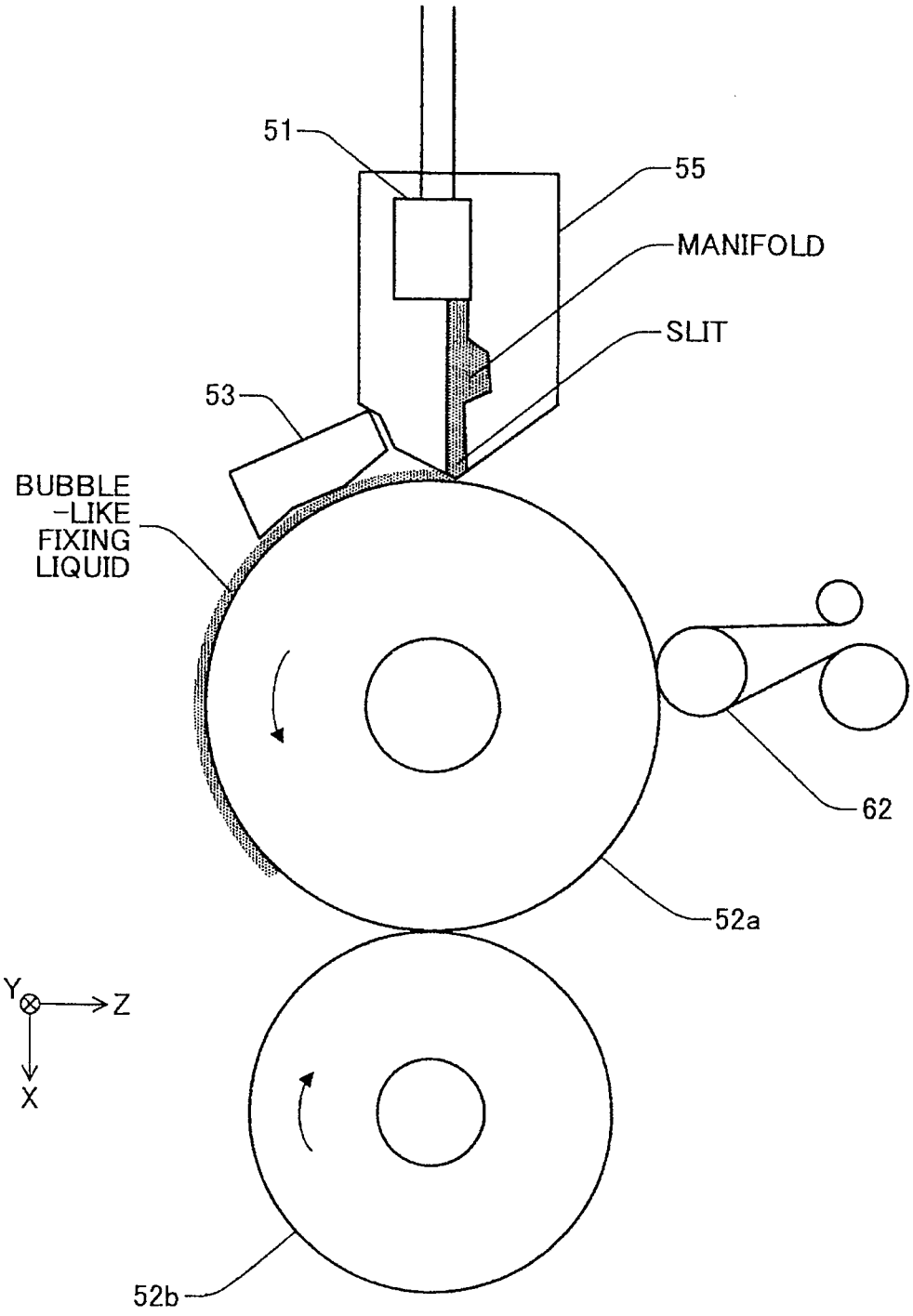
FIG. 5 is a drawing illustrating a function of a blade.

The blade 53 is disposed on the −z side of the application head 55, and regulates the film thickness of the bubble-like fixing liquid supplied from the application head 55 and adhered to the surface of the application roller 52*a* (see FIG. 5). Further, the interval between the blade 53 and the application roller 52*a* may be arbitrarily adjusted.

Figure 6:
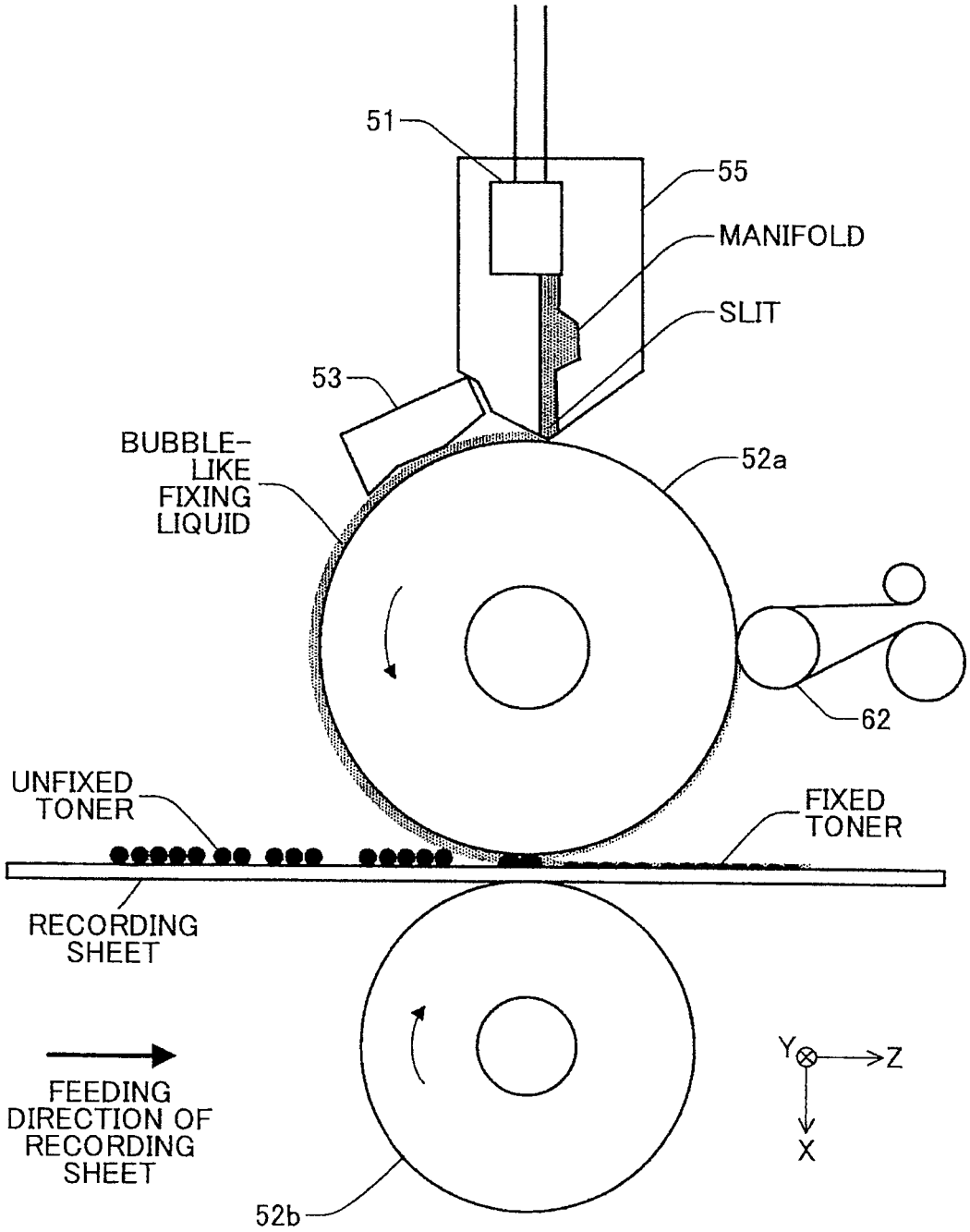
FIG. 6 is a drawing illustrating a cleaning device.

The cleaning device 62 is disposed on the +Z side of the application roller 52*a*, and removes offset toner adhered to the surface of the application roller 52*a* and the bubble-like fixing liquid and the liquid-like fixing liquid not having been supplied to the recording sheet from the surface of the application roller 52*a*, so as to restore the surface of the application roller 52*a* to a cleaned state (see FIG. 6). The removed bubble-like fixing liquid and the liquid-like fixing liquid are collected.

Further, in the vicinity of the feeding path of the recording sheet on which the toner is fixed by the fixing device 2050, there is disposed the moisture detector 11. The moisture detector 11 is an optical-type moisture detector that irradiates light onto the surface of the recording sheet, receives the light reflected on the surface, and detects the moisture in the recording sheet based on the received light. The detected result is reported to the application amount control device 59 using an electric signal. Namely, the moisture detector 11 detects the moisture in the recording sheet after toner on the recording sheet is fixed.

In this embodiment, as the moisture detector 11, an infrared moisture meter is used that uses water characteristics of absorbing light having specific wavelengths (e.g., 1.2 μm, 1.45 μm, and 1.94 μm). In this case, the more the moisture included in the recording sheet is, the lower the intensity of light having the specific wavelengths included in the reflected light becomes. Further, to increase the detection accuracy, light having the wavelengths close to the specific wavelengths may also be considered.

Figure 7:
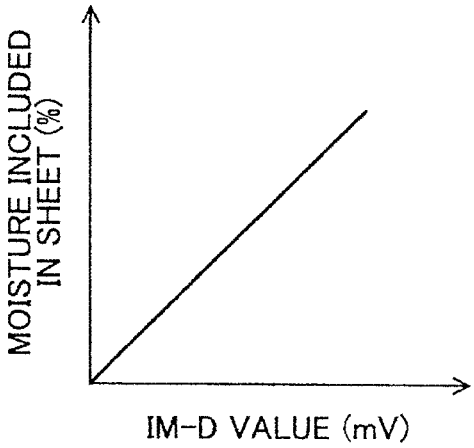
FIG. 7 is a graph illustrating an exemplary IM-D calibration.

In this embodiment, for each of the types of the sheets (recording sheets), in advance, the relationships between output values of the moisture detector 11 ("IM-D values") and the moisture (%) included in the recording sheet are obtained (the relationships are expressed by using (may be referred to as) "IM-D calibration curve" as illustrated in FIG. 7) and are stored in the ROM of the application amount control device 59.

Further, in the vicinity of the feeding path of the recording sheet on which the toner is fixed by the fixing device 2050, there is disposed the recording sheet detection sensor 12. Further, the recording sheet detection sensor 12 is disposed on the +Z side of the moisture detector 11. Further, the recording sheet detection sensor 12 optically detects (determines) whether there is the recording sheet on the feeding path of the recording sheet. The detection result is reported to the application amount control device 59 using an electric signal.

The application amount control device 59 controls the liquid-like fixing liquid supply pump 56*a* and the air supply pump 56*b* in a manner such that the application amount of the bubble-like fixing liquid to be applied to the recording sheet is a predetermined application amount based on the humidity information from the humidity sensor 10, the moisture information from the moisture detector 11, the information indicating whether there is the recording sheet from the recording sheet detection sensor 12 and the like.

Figure 8:
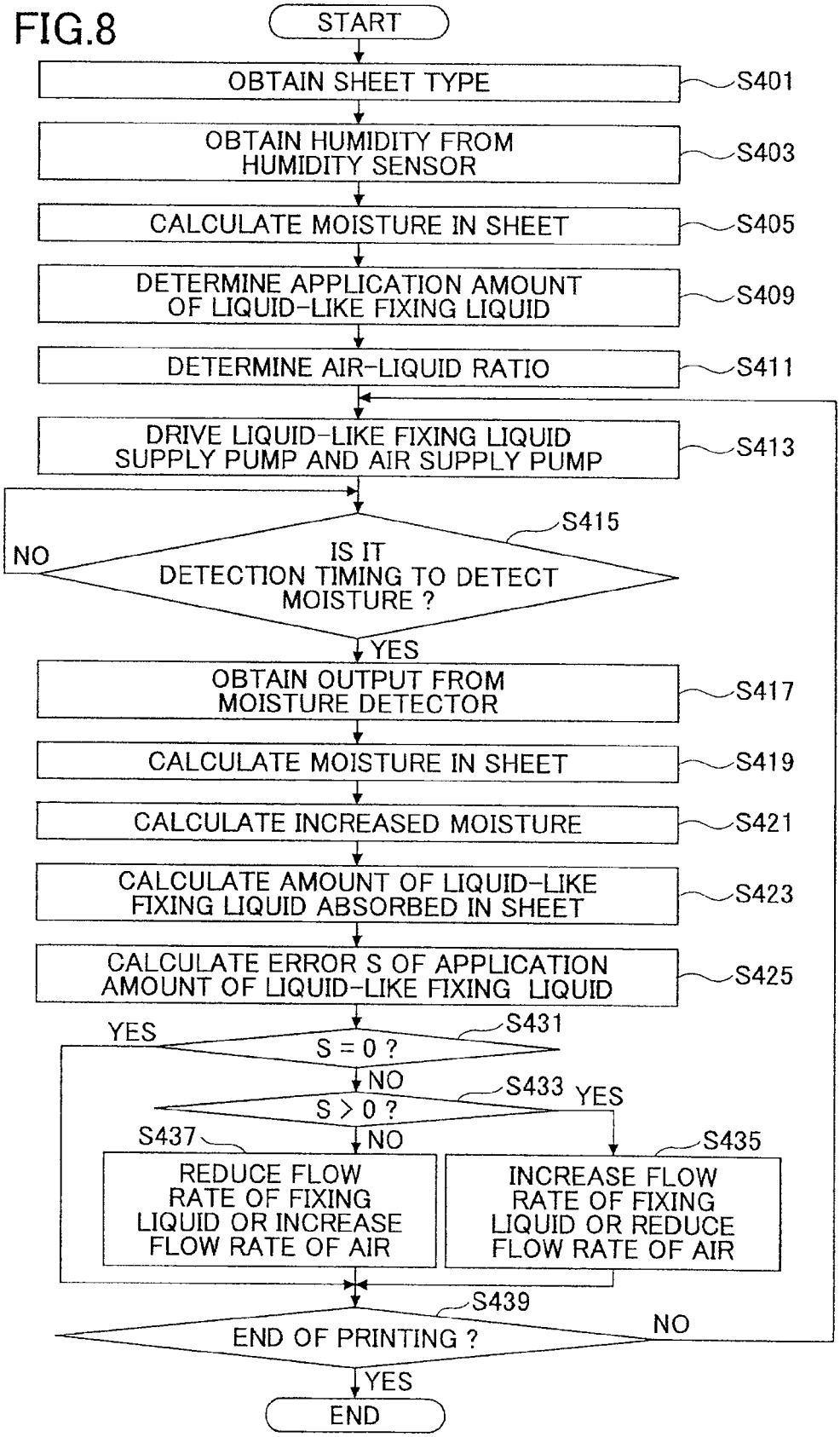
FIG. 8 is a flowchart illustrating an exemplary application amount control process.
Figure 9:
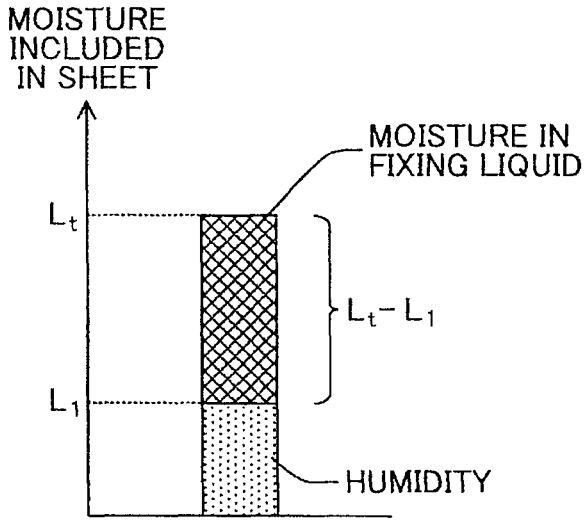
FIG. 9 is a graph for determining an application amount.

Next, a process performed by the application amount control device 59 (hereinafter referred to as an "application amount control process") is described with reference to FIG. 8. FIG. 8 is a flowchart illustrating the application amount control process corresponding to a series of process algorithms performed by the CPU of the application amount control device 59.

Upon receiving information to start printing from the printer control device 2090, the application amount control device 59 starts the application amount control process based on a program stored in the ROM. Herein, it is assumed that printing is performed on plural recording sheets.

First, in step S401, the application amount control device 59 obtains the information indicating the type of the recording sheet. Herein, it is assumed that the information indicating the type of the recording sheet is registered by a user in advance, and that the information is stored in the ROM of the application amount control device 59.

Next, in step S403, the application amount control device 59 obtains the humidity (%) value from the humidity sensor 10.

Next, in step S405, the application amount control device 59 refers to the relevant humidity-moisture calibration curve stored in the ROM, and obtains the moisture (%) included in the recording sheet.

In this case, the relationships between the moisture $L_1$ (mg) included in the recording sheet and the moisture $w_1$ (%) are expressed in the following formula (1).

$$w_1=(L_1/m_0)\times 100 \quad (1)$$

where the symbol "$m_0$ (mg)" denotes the weight of the recording sheet before fixing.

When the total weight of the recording sheet before fixing is given as "x" (mg), the following formula (2) is obtained $$m_0=x+L_1 \quad (2)$$

In the following, the moisture obtained above may also be called "pre-fixing moisture".

Next, in step S409, based on a predetermined moisture target value $L_t$ (mg) and the above pre-fixing moisture $L_1$ (mg), an application amount $C_H$ (mg) of the liquid-like fixing liquid is determined.

Further, the moisture target value $L_t$ (mg) is a value that ensures a certain level of fixing quality (preventing the curl, the offset toner and the like), and is determined based on fixing conditions including the type of the recording sheet, a pressure, a nip time and the like. Further, the moisture target value $L_t$ (mg) may be changed by, for example, a service person during maintenance service.

On the other hand, the recording sheet before fixing includes atmospheric moisture. This moisture refers to the pre-fixing moisture $L_1$ (mg). Generally, the moisture target value $L_t$ (mg) is greater than the pre-fixing moisture $L_1$ (mg) (i.e., $L_t>L_1$). Further, the liquid-like fixing liquid includes moisture as dilution solvent (see FIG. 4). Therefore, it is thought that, by adjusting the moisture from the liquid-like fixing liquid to be equal to a value of "$L_t-L_1$", the moisture included in the recording sheet after fixing corresponds to the moisture target value $L_t$ (see FIG. 9).

In this embodiment, the application amount $C_H$ (mg) refers to the amount of liquid-like fixing liquid having moisture equal to the value of "$L_t - L_1$". In the following, the application amount determined in this step may also be called a "pre-fixing application amount".

Next, in step S411, based on the above pre-fixing application amount $C_H$ (mg), the application amount control device 59 determines the air-liquid ratio. Namely, the application amount control device 59 determines the bubble density in the bubble-like fixing liquid. The information indicating the relationships between the pre-fixing application amount $C_H$ (mg) and the air-liquid ratio are stored in the ROM.

Next, in step S413, based on the determined air-liquid ratio, the application amount control device 59 controls the liquid-like fixing liquid supply pump 56*a* and the air supply pump 56*b*. By doing this, the liquid-like fixing liquid and air are supplied to the bubble generation device 51 at the corresponding flow rates based on the determined air-liquid ratio.

On the other hand, theoretically, when the bubble-like fixing liquid generated based on the determined air-liquid ratio is applied to the recording sheet for fixing, a certain level of fixing quality is to be obtained. However, practically, the fixing quality may not be consistent due to fluctuations of a transfer rate and fixing conditions.

Next, in step S415, the application amount control device 59 waits until (determines whether) the recording sheet is fed to the detection area of the moisture detector 11 by monitoring the output signal from the recording sheet detection sensor 12. When determining that the recording sheet is fed to the detection area of the moisture detector 11 (YES in step S145), the process goes to step S417.

Next, in step S417, the application amount control device 59 obtains the output (i.e., the IM-D value) from the moisture detector 11.

Next, in step S419, the application amount control device 59 refers to the relevant IM-D calibration curve, and obtains the moisture (%) included in the recording sheet based on the IM-D value obtained in step S417. In the following, the moisture obtained in this step may also be called a "post-fixing moisture".

On the other hand, the weight m (mg) of the recording sheet after the bubble-like fixing liquid is applied to the recording sheet is expressed in the following formula (3).

$$m = x + L_H' + L_1 + D_H' + \alpha \quad (3)$$

In formula (3), the symbol "$L_H'$" denotes the moisture (mg) absorbed into the recording sheet by fixing; the symbol "$D_H'$" denotes the solvent amount (mg) absorbed into the recording sheet by fixing; and the symbol "α" denotes the toner amount (mg).

Then, the moisture "$w_2$" (%) included in the recording sheet after the bubble-like fixing liquid is applied to the recording sheet is expressed in the following formula (4).

$$w_2 = (L_H' + L_1)/(x + L_H' + L_1 + D_H' + \alpha) \times 100 \quad (4)$$

Further, a ratio "K" between the moisture and the other solvent included in the liquid-like fixing liquid is expressed in the following formula (5).

$$K = D_H'/L_H' \quad (5)$$

By substituting the above formulas (1), (2), and (5) in the above formula (4), the following formula (6) is obtained.

$$w_2 = (L_H' + w_1 * m_0/100)/(L_H' + K * L_H' + m_0 + \alpha) \times 100 \quad (6)$$

Figure 10:
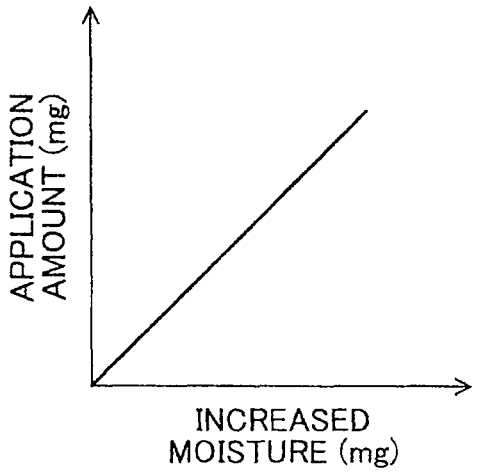
FIG. 10 is a graph illustrating relationships between increased moisture and the application amount.

Next, in step S421, based on the following formula (7) obtained by modifying the formula (6), the application amount control device 59 calculates the increased moisture $L_H'$ (mg) by fixing. The relationships between the application amount and the increased moisture are illustrated in FIG. 10.

$$L_H' = \{m_0(w_2 - w_1) + w_2 * \alpha\}/\{100 - w_2(1+K)\} \quad (7)$$

Next, in step S423, based on the following formula (8), the application amount control device 59 calculates a bubble-like fixing liquid amount "$C_H'$" absorbed in the recording sheet.

$$C_H' = L_H'(1+K) \quad (8)$$

Next, in step S425, based on the following formula (9), the application amount control device 59 calculates an error "S" of the application amount of the liquid-like fixing liquid.

$$S = C_H - C_H' \quad (9)$$

Next, in step S431, the application amount control device 59 determines whether the error "S" is zero (S=0). When determining that the error "S" is other than zero (NO in step S431), the process goes to step S433.

In step S433, the application amount control device 59 determines whether the error "S" is greater than zero (S>0). When determining that the error "S" is greater than zero (YES in step S433), the process goes to step S435.

In step S435, depending on the value of the error "S", the application amount control device 59 controls to increase the flow rate of the liquid-like fixing liquid or reduce the flow rate of air, so as to increase the bubble density in the bubble-like fixing liquid generated in the bubble generation device 51.

On the other hand, in step S433, when determining that the error "S" is less than zero (NO in step S433), the process goes to step S437.

In step S437, depending on the value of the error "S", the application amount control device 59 controls to reduce the flow rate of the liquid-like fixing liquid or increase the flow rate of air, so as to reduce the bubble density in the bubble-like fixing liquid generated in the bubble generation device 51.

Next, in step S439, the application amount control device 59 determines whether the printing is finished. For example, when determining that the number of the recording sheets after fixing is less than the number of the recording sheets to be printed (NO in step S439), the process goes back to step S413. On the other hand, when determining that the number of the recording sheets after fixing is equal to the number of the recording sheets to be printed (YES in step S439), the application amount control process ends.

Further, in above step S431, when determining that the error "S" is equal to zero (S=0), the process goes to step S439.

By performing the application amount control process, for example when the penetration rate of the fixing liquid changes (differs) due to the difference of the atmospheric moisture (i.e., moisture in the recording sheet before fixing), by adjusting the bubble density in the bubble-like fixing liquid in a manner such that the increased moisture included in the recording sheet after fixing is always maintained at a predetermined value, it may become possible to obtain stable image quality and minimize the use of the fixing liquid.

On the other hand, the application amount of the fixing liquid may be changed by changing the transfer pressure and the transfer nip time. However, when those factors (the transfer pressure and the transfer nip time) are changed, new problems such as bubble accumulation and toner offset may occur. Further, it is also expected that the image quality such as a gloss level may be degraded.

On the other hand, in this embodiment, the application amount of the fixing liquid is changed by changing the bubble density of the bubble-like fixing liquid. This may be achieved only by changing (adjusting) the ratio (the air-liquid ratio) between the air and the liquid-like fixing liquid to be supplied to the bubble generation device 51. Because of this feature, it may become possible to perform control the application amount of the fixing liquid more strictly with a simple configuration.

Referring back to FIG. 1, the recording sheets on which the toner image is fixed by the fixing device 2050 are further fed to the sheet discharging tray 2070 by the sheet discharging roller 2058, and sequentially stacked on the sheet discharging tray 2070.

As apparent from the above description, the color printer 2000 according to an embodiment of the present invention includes the application amount control device 59 serving as a control device according to an embodiment of the present invention.

Further, a fixing method according to an embodiment of the present invention is achieved by the above application amount control process.

As described above, the color printer 2000 according to an embodiment of the present invention includes the fixing device 2050, the humidity sensor 10, and the moisture detector 11. The fixing device 2050 applies the bubble-like fixing liquid to the toner having been adhered to the recording sheet and fixes the toner to the recording sheet. The bubble-like fixing liquid is generated by transforming a fixing liquid into foam for dissolving or swelling at least a part of the resin. The humidity sensor 10 detects the moisture included in the recording sheet before the bubble-like fixing liquid is applied to the recording sheet. The moisture detector 11 detects the moisture included in the recording sheet after the bubble-like fixing liquid is applied to the recording sheet.

The fixing device 2050 includes the bubble generation device 51, the pressing roller 52*b*, the blade 53, the application head 55, the liquid-like fixing liquid supply pump 56*a*, the air supply pump 56*b*, the liquid-like fixing liquid container 57, the application amount control device 59 and the like.

Further, before the bubble-like fixing liquid is applied to the recording sheet, the application amount control device 59 determines the application amount of the liquid-like fixing liquid based on the detection result of the humidity sensor 10. Further, after fixing, the application amount control device 59 obtains the liquid-like fixing liquid absorbed in the recording sheet based on the detection result of the moisture detector 11, so that the application amount control device 59 adjusts the bubble density of the bubble-like fixing liquid based on the determined application amount of the liquid-like fixing liquid and the absorbed amount of the liquid-like fixing liquid.

By having the configuration described above, even in environmental fluctuation or continuous sheet feed, it may become possible to adjust the application amount of the fixing liquid to obtain a desired increased moisture and always maintain an appropriate application amount of the fixing liquid. Further, even in continuous sheet feeding, it may become possible to achieve the good balance between the slight amount of application of the fixing liquid to the toner layer on the recording medium and the prevention of the toner offset to the application roller, thereby stabilizing the fixing quality and minimizing the usage amount of the fixing liquid.

Therefore, it may become possible to reduce the power consumption without degrading the image quality and reducing the image forming speed. Further, it may become possible to delay the timing when the container storing the fixing liquid is to be exchanged.

Further, in the above embodiment, a case is described where the humidity sensor 10 is disposed in the vicinity of the sheet feeding tray 2060. However, the present invention is not limited to this configuration. The humidity sensor 10 may be disposed at any appropriate position on the upstream side of the fixing device 2050. For example, the humidity sensor 10 may be disposed between the sheet feeding roller 2054 and the resist roller pair 2056.

Further, at least a part of the process performed by the application amount control device 59 may be performed by the printer control device 2090.

Further, the particles including resin to be fixed is not limited to toner. Any particles including resin may be used, for example, particles including resin having an electrically conductive material.

Further, the medium (i.e., recording sheet) on which an image is formed is not limited to a sheet. For example, any appropriate material such as fiber, metal, resin, ceramic or the like may be used. However, it is preferable that the medium has a liquid permeability to penetrate the fixing liquid. When a medium has no liquid permeability, the medium may have a penetration layer on the surface of the medium.

Further, the shape of the medium is not limited to a sheet shape. The medium may have a cubic shape including a plane surface or a curved surface.

The fixing device according to an embodiment of the present invention may also be applied to so-called varnish coating where transparent resin particles are uniformly fixed to the surface of a sheet to protect the surface of the sheet.

According an embodiment of the present invention, there is provided a fixing device applying a bubble-like fixing liquid to resin-containing particles adhered to a medium so that the resin-containing particles are fixed to the medium, the bubble-like fixing liquid being formed by foaming a fixing liquid that dissolves or swells at least a part of the resin. The fixing device includes a control device that, based on a difference between a moisture content included in the medium after fixing and a target value of the moisture content, adjusts an application amount of the fixing liquid for a next medium.

By having this configuration, it may become possible to stably apply an appropriate amount of fixing liquid to a medium (recording sheet) regardless of the usage environment.

According to an embodiment of the present invention, there is provided an image forming apparatus including a fixing device that fixes unfixed toner image using a fixing liquid, the unfixed toner image being formed on a medium based on image information, where the fixing device is a fixing device according to an embodiment of the present invention.

By having this configuration including the fixing device according to an embodiment of the present invention, it may become possible to reduce the power consumption without degrading the image quality and reducing the speed of forming images.

According to an embodiment of the present invention, there is provided a fixing method of applying a bubble-like fixing liquid to resin-containing particles adhered to a medium so that the resin-containing particles are fixed to the medium, the bubble-like fixing liquid being formed by transforming a fixing liquid into foam that dissolves or swells at least a part of the resin. The fixing method including an application amount determination step of determining an application amount of the fixing liquid based on a moisture content included in the medium before the bubble-like fixing liquid is applied; an application step of applying the bubble-like fixing liquid to the medium based on the determined application amount; and an application amount adjusting step of, after fixing, obtaining an amount of the fixing liquid absorbed in the medium based on a moisture content included in the medium, and adjusting the application amount of the fixing liquid to be applied to a next medium based on a difference between the determined application amount and the amount of the fixing liquid absorbed in the medium.

By having this configuration, it may become possible to stably apply an appropriate amount of fixing liquid to a medium regardless of usage environment.

As described above, the fixing device according to an embodiment of the present invention is suitable to stably apply an appropriate amount of a fixing liquid to a medium regardless of usage environment. Further, the image forming apparatus according to an embodiment of the present invention is suitable to reduce the consumption of power without degrading the image quality and reducing the speed of forming images. Further, the fixing method according to an embodiment of the present invention is suitable to stably apply an appropriate amount of a fixing liquid to a medium regardless of usage environment.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device applying a fixing liquid to resin-containing particles adhered to a medium so that the resin-containing particles are fixed to the medium, the fixing liquid being formed by transforming a liquid into foam that dissolves or swells at least a part of the resin, the fixing device comprising:

a control device that, based on a difference between a moisture content included in the medium after fixing and a target value of the moisture content, adjusts an application amount of the liquid for a next medium.

2. The fixing device according to claim 1, wherein the control device adjusts the application amount of the liquid by adjusting a bubble density of the fixing liquid.

3. The fixing device according to claim 2, wherein the control device performs control to increase the bubble density when the difference is greater than zero, and reduce the bubble density when the difference is less than zero.

4. The fixing device according to claim 2, further comprising:

a bubble generation device that generates the fixing liquid based on the liquid and air separately supplied to the bubble generation device, wherein the bubble generation device adjusts the bubble density of the fixing liquid generated by the bubble generation device by adjusting at least one of a flow rate of the liquid and a flow rate of air supplied to the bubble generation device.

5. An image forming apparatus including a fixing device that fixes an unfixed toner image using a fixing liquid, the unfixed toner image being formed on a medium based on image information, wherein the fixing device is the fixing device according to claim 1.

6. The image forming apparatus according to claim 5, further comprising:

a moisture detector that detects a moisture content included in the medium after fixing.

7. The image forming apparatus according to claim 6, wherein the moisture detector is an optical-type moisture detector.

8. A fixing method of applying a fixing liquid to resin-containing particles adhered to a medium so that the resin-containing particles are fixed to the medium, the fixing liquid being formed by transforming a liquid into foam that dissolves or swells at least a part of the resin, the fixing method comprising:

an application amount determination step of determining an application amount of the liquid based on a moisture content included in the medium before the fixing liquid is applied;

an application step of applying the fixing liquid to the medium based on the determined application amount; and an application amount adjusting step of, after fixing, obtaining an amount of the liquid absorbed in the medium based on a moisture content included in the medium, and adjusting the application amount of the liquid to be applied to a next medium based on a difference between the determined application amount and the amount of the liquid absorbed in the medium.

9. The fixing method according to claim 8, wherein, in the application amount determination step, the application amount of the liquid is determined based on a difference between the moisture content included in the medium before the fixing liquid is applied and a target value of the moisture content to be included in the medium after fixing.

10. The fixing method according to claim 8, wherein, in the application amount adjusting step, an increased moisture content due to fixing is calculated based on a moisture content included in the medium after fixing, and the amount of the liquid absorbed in the medium based on the increased moisture content.

11. The fixing method according to claim 8, wherein, in the application amount adjusting step, the application amount of the liquid is adjusted by adjusting a bubble density of the fixing liquid.

12. The fixing method according to claim 11, wherein, in the application amount adjusting step, the bubble density is increased when the difference is greater than zero, and the bubble density is reduced when the difference is less than zero.

* * * * *